United States Patent [19]

Deck

[11] Patent Number: 4,491,526

[45] Date of Patent: Jan. 1, 1985

[54] THICKENED, WATER-BASED HYDRAULIC FLUID WITH REDUCED DEPENDENCE OF VISCOSITY ON TEMPERATURE

[75] Inventor: Charles F. Deck, Trenton, Mich.

[73] Assignee: BASF Wyandotte Corporation, Wyandotte, Mich.

[21] Appl. No.: 481,761

[22] Filed: Apr. 4, 1983

[51] Int. Cl.[3] ..... C10M 1/46; C10M 1/06

[52] U.S. Cl. ..... 252/32.5; 252/49.3; 252/78.5; 252/315.1; 72/42

[58] Field of Search ..... 252/32.5, 49.3, 78.5, 252/315.1, 316; 72/42

[56] References Cited

U.S. PATENT DOCUMENTS

| | | | |
|---|---|---|---|
| 4,312,775 | 1/1982 | Panek et al. | 252/78.5 |
| 4,384,965 | 5/1983 | Hellsten et al. | 252/49.5 |
| 4,395,351 | 7/1983 | Camp | 252/78.5 |

*Primary Examiner*—Jacqueline V. Howard

*Attorney, Agent, or Firm*—David L. Hedden; Joseph D. Michaels

[57] ABSTRACT

Improved hydraulic fluids or metalworking lubricants, utilizing mixtures of water, metal lubricants, metal corrosion inhibitors, and an associative polyether thickener, have reduced dependence of the viscosity on temperature achieved by the incorporation therein of an ethoxylated polyether surfactant.

14 Claims, No Drawings

THICKENED, WATER-BASED HYDRAULIC FLUID WITH REDUCED DEPENDENCE OF VISCOSITY ON TEMPERATURE

BACKGROUND OF THE INVENTION

1. Field of the Invention

This invention relates to water-based metalworking fluids and hydraulic fluids.

2. Description of the Prior Art

Thickened, water-based hydraulic fluids and metalworking fluids are known in the prior art from U.S. Pat. Nos. 4,138,346 and 4,151,099. The hydraulic fluids disclosed comprise a high molecular weight, non-associative, polyalkylene glycol thickener, a phosphate ester and a sulfur-containing compound or polyester of an oxyalkylene compound and a sulfur-containing compound alone or including a phosphate ester. A polyether-thickened, water-based hydraulic fluid or metalworking fluid is disclosed in U.S. Pat. Nos. 4,312,768 or 4,312,775. The latter patent teaches that increased thickening efficiency can be obtained utilizing a synergistic combination of an associative polyether thickener, as disclosed, with a mixture of a water-soluble amine and an ethoxylated phosphate ester. In U.S. Pat. No. 4,304,902, a copolymer of a 1,2-epoxy-n-alkane with ethylene oxide is disclosed which is solubilized in an aqueous medium by an ethoxylated surfactant to provide a substantial increase in viscosity.

In no one of these prior art references is the fact disclosed that aqueous solutions of the associative polyether thickeners are susceptible to substantially greater viscosity reduction upon heating than the non-associative polyether thickeners. Reduced temperature dependence of the viscosity of an aqueous medium utilized as a hydraulic fluid is required to more closely simulate the properties of the commonly used hydrocarbon oil-based hydraulic fluids.

SUMMARY OF THE INVENTION

A water-based hydraulic fluid or metalworking composition can be obtained by blending water in a major proportion with minor effective thickening amounts of a mixture comprising at least one associative, polyether aqueous thickener and an amount of an ethoxylated polyether surfactant effective to reduce the temperature dependence and thus stabilize the thickening effect of said associative polyether thickener at elevated temperatures.

Said associative polyether thickener can be any known in the prior art. Preferably said thickener is a polyether having a molecular weight generally of about 1000 to about 75,000 which is prepared by reacting ethylene oxide or ethylene oxide and at least one lower alkylene oxide having 3 to 4 carbon atoms with at least one active hydrogen-containing compound containing at least one active hydrogen and subsequently or simultaneously reacting therewith at least one long chain, aliphatic alpha-olefin oxide or glycidyl ether having a carbon chain length of about 12 to about 18 aliphatic carbon atoms, The water-based compositions of the invention are more similar to hydrocarbon oils in their rheological properties, especially in their reduced sensitivity to the reduction of the viscosity upon increase in temperature, than prior art water-based hydraulic fluids and metalworking compositions containing associative polyether thickeners. The hydraulic fluids of the invention are useful where force is transmitted hydraulically as well as in the working of metal where a lubricant is required to be in contact with the metal as it is worked mechanically.

DETAILED DESCRIPTION OF THE INVENTION

In accordance with this invention, it has been found that ethoxylated polyether surfactants are useful additives for water-based, associative thickener-containing hydraulic fluids or metalworking compositions in order to reduce the substantial dependence of the viscosity of such fluids upon variations in temperature. The invention is especially applicable to hydraulic fluids containing polyether polyol thickeners such as those disclosed in U.S. Pat. Nos. 4,288,639 and 4,312,775, both incorporated herein by reference. The polyether polyol thickeners are prepared by first reacting ethylene oxide or ethylene oxide and generally at least one lower alkylene oxide with at least one active hydrogen-containing compound containing at least one active hydrogen and subsequently or simultaneously reacting therewith at least one long chain aliphatic alpha-olefin oxide or glycidyl ether. Said long chain oxide or glycidyl ether has a carbon chain length of about 12 to about 18 aliphatic carbon atoms. The proportion of said alpha-olefin oxide or glycidyl ether present in the polyether thickener is 1 to about 20 percent by weight, based upon the total weight of the thickener.

The modified polyether polyol thickening agents utilized to thicken the hydraulic fluids and metalworking fluids of the invention can be obtained in one embodiment of the invention by modifying a conventional polyether aqueous thickener with an alpha-olefin epoxide having about 12 to about 18 carbon atoms or mixtures thereof. The conventional polyether polyol thickening agent can be an ethylene oxide-derived homopolymer or a heteric or block copolymer of ethylene oxide and at least one lower alkylene oxide preferably having 3 to 4 carbon atoms. Said ethylene oxide is used generally as a reactant in the proportion of at least 10 percent by weight based upon the total weight of the polyether thickener. Preferably, about 70 to 99 percent by weight ethylene oxide is utilized with about 30 to 1 percent by weight of a lower alkylene oxide preferably having 3 to 4 carbon atoms.

The preferred polyether thickeners useful in the invention can be prepared by reacting an active hydrogen-containing compound in the presence of an acidic or basic oxyalkylation catalyst and an inert organic solvent at elevated temperatures in the range of about 50° C. to 150° C. under an inert gas pressure, generally from about 20 to about 100 pounds per square inch gauge. Generally, both monohydric and polyhydric alcohol initiators are useful. Useful polyhydric alcohol initiators are selected from the alkane polyols, alkene polyols, alkyne polyols, aromatic polyols, and oxyalkylene polyols. Monohydric alcohol initiators which are useful include aliphatic monohydric alcohols and alkyl phenols containing about 12 to about 18 carbon atoms in the aliphatic or alkyl group. In addition, aliphatic mercaptans having about 12 to about 18 carbon atoms are useful initiators.

Heteric, block, and homopolyer polyethers can be used to prepare suitable aqueous thickeners by further reacting said polyethers preferably having a molecular weight of about 1000 to about 40,000 with said long chain, aliphatic alpha-olefin epoxide or glycidyl ether so as to provide a capped polyether. Alternatively, polyethers suitable as thickeners for the hydraulic fluids of the invention can be obtained by the heteric polymerization of at least one alkylene oxide having 2 to 4 carbon atoms and said long chain aliphatic alpha-olefin epoxide or glycidyl ether.

The metalworking fluids and hydraulic fluids of the invention preferably contain minor effective amounts of a phosphate ester salt selected from the group consisting of

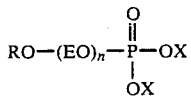

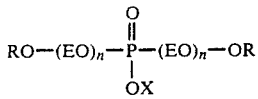

and mixtures thereof wherein EO is the residue of ethylene oxide; R is a monovalent alkylaryl group wherein the alkyl group thereof has about 4 to about 20 carbon atoms; X is individually selected from the group consisting of an alkali metal, an alkaline earth metal, the residue of ammonia, the residue of an amine, and mixtures thereof; n is generally a number from 1 to 50, and preferably 2 to 10. Said phosphate ester is preferably the condensation product of an alkyl phenol having about 4 to about 20 carbon atoms in the alkyl group with about 5 to about 20 moles of ethylene oxide. Said alkyl phenol is preferably octyl phenol, nonylphenol, dinonylphenol, dodecylphenol and mixtures thereof.

The preparation of these phosphate esters is more fully disclosed in U.S. Pat. Nos. 3,004,056 and 3,004,057 incorporated herein by reference. In general, the phosphate esters utilized are obtained by esterifying one mole of a non-ionic surface-active agent. Such non-ionic surface-active agents are well known in the prior art and are generally prepared by condensing an alkylene oxide with a reactive hydrogen compound. Thus, one mole of the condensation product of at least one mole of ethylene oxide with one mole of an alkyl phenol having a reactive hydrogen atom is suitable. The amount of ethylene oxide utilized in the condensation product will depend primarily upon the particular alkylaryl phenol with which the ethylene oxide is condensed. Generally an amount of ethylene oxide is employed which will result in a condensation product containing about 20 to about 85 percent by weight of combined ethylene oxide. The optimum amount of ethylene oxide for the attainment of the desired lipophilic-hydrophilic balance can be readily determined in any particular case by preliminary test and routine experimentation.

Examples of non-ionic surface-active agent condensation products which are useful in the preparation of said phosphate esters are as follows:

nonylphenol +9 to 11 moles of ethylene oxide,
dinonylphenol +2 moles of ethylene oxide, and
dodecylphenol +10 moles of ethylene oxide.

It is believed that certain of the advantageous properties of the phosphate ester are contributed by the phosphorus element of the ester. It is known that this element can contribute to antiwear and extreme pressure performance of a lubricant composition. The lubricity which is required in the metalworking and hydraulic fluid compositions of the invention is believed to be contributed primarily by the alkylaryl or polyethoxyethylene moieties. To obtain the necessary water solubility for such phosphate esters, a proper balance of hydrophilic-lipophilic properties is required. The ethoxylation of the alkyl phenol provides the necessary water solubility. Aqueous solutions of the phosphate esters are stable under neutral and alkaline conditions and show little tendency to hydrolyze during storage.

Generally at least 0.1 percent by weight to about 5 percent by weight, preferably about 0.15 to about 3 percent by weight of the above-described phosphate ester can be utilized in the hydraulic fluid compositions of the invention in order to provide anti-wear and corrosion inhibiting properties.

In order to reduce the temperature sensitivity of the viscosity of the associative, polyether thickener in an aqueous medium, relatively large amounts of ethoxylated polyether surfactants are required in proportion to the amount of associative, polyether thickener utilized. In addition to providing a reduction in temperature sensitivity of the viscosity of aqueous solutions of the associative, polyether thickener, these polyether surfactants also tend to increase the viscosity of the thickened aqueous medium. Thus, said polyether surfactants often provide substantial synergistic thickening effects in combination with said associative polyether thickener. Several classes of ethoxylated polyether surfactants have been found to be particularly effective, for the purposes of this invention, in combination with said associative polyether thickener. These ethoxylated polyether surfactants are more particularly described as follows:

A first ethoxylated polyether surfactant useful as an additive to reduce the temperature sensitivity of aqueous solutions of an associative polyether thickener is an ethoxylated polyether prepared by reacting an aliphatic, preferably linear, alcohol or amine initiator having about 12 to about 18 carbon atoms, preferable about 12 to about 15 carbon atoms, with ethylene oxide to prepare a homopolymer containing the residue of about 5 to about 30 moles of ethylene oxide. Preferably, about 5 to about 20 moles of ethylene oxide are racted with said alcohol or amine to prepare said homopolymer polyether surfactants. Alternatively, block or heteric copolymers can be prepared using as reactants ethylene oxide and a lower alkylene oxide, preferably having 3 to 4 carbon atoms. The residue of ethylene oxide in said polyether copolymer generally is at least about 70 percent by weight when the lower alkylene oxide used with ethylene oxide has 3 carbon atoms. The ethylene oxide residue in the polyether obtained generally is about 80 percent by weight when a lower alkylene oxide containing 4 carbon atoms is utilized with ethylene oxide in the preparation of said ethoxylated surfactant. Preferably, the molecular weight of said surfactant is about 500 to about 2000. Representative aliphatic alcohol or amine initiators are octadecyl alcohol, stearyl amine, lauryl alcohol, lauryl amine, myristyl alcohol or amine, and cetyl alcohol or amine.

A second ethoxylated polyether surfactant useful in combination with said associative polyether aqueous thickeners is a polyoxyethylene-polyoxybutylene copolymer wherein the polyoxybutylene portion of the compound has a molecular weight of about 500 to about 2000 and the polyoxyethylene portion thereof provides about 60 to about 90 percent by weight of the compound. Block or heteric copolymer ethoxylated surfactants can be prepared by reacting a monomeric diol initiator such as butylene glycol with 1,2-butylene oxide to form an intermediate having a desired molecular weight of about 500 to about 2000. This intermediate is subsequently reacted with ethylene oxide so that the ethylene oxide residue in said copolymer constitutes at least 60 percent by weight and preferably, about 60 to about 90 percent by weight of the final polymer.

As is well known in the art, mixtures of butylene oxide and ethylene oxide and/or 1,2-propylene oxide can be used to partially replace some of the butylene oxide used in the preparation of the predominantly oxybutylene derived hydrophobic chains of the polymer. In addition, the terminal ethylene oxide residue groups on the polymer can contain small amounts of alkylene oxides such as propylene oxide and butylene oxide. It is to be understood that the expression "polyoxyethylene-polyoxybutylene heteric or block copolymer" can indicate the presence of small amounts of propylene oxide, and/or ethylene oxide residues in the hydrophobic polyoxybutylene portion of the polymer. In addition, small amounts of propylene oxide and/or butylene oxide residues can be present in the hydrophilic ethylene oxide-derived groups which are preferably terminal in the polymer. A more detailed disclosure of the preparation of the polyoxyethylene-polyoxybutylene copolymer can be found in U.S. Pat. No. 2,828,345, incorporated herein by reference.

A third group of ethoxylated polyether surfactants useful in combination with said associative polyether thickeners are the ethoxylated alkyl phenols having 1 to about 20 alkyl carbon atoms in the alkyl group and a molecular weight of about 500 to about 2000. These are derived from the reaction of ethylene oxide to produce a homopolymer. Alternatively, a block or heteric copolymer is prepared by reacting ethylene oxide and a lower alkylene oxide, preferably having 3 to 4 carbon atoms with an alkyl phenol. The alkyl phenol preferably has about 4 to about 20 carbon atoms in the alkyl group. Preferably, the ethoxylated alkyl phenols are derived from the reaction of said alkyl phenol with ethylene oxide or ethylene oxide and at least one lower alkylene oxide preferably having 3 to 4 carbon atoms provided that the ethoxylated polyether copolymer surfactant obtained thereby contains at least 60 percent by weight, preferably about 60 percent to about 90 percent by weight of ethylene oxide residue. The ethoxylated homopolymer alkyl phenols contain the residue of about 5 to about 20 moles of ethylene oxide. Representative alkyl phenols useful in the preparation of the alkoxylated alkyl phenol surfactants are octyl phenol, nonylphenol, dodecylphenol and dinonylphenol dodecylphenol and mixtures thereof.

Generally about 1 to about 5 percent by weight, preferably about 2 to about 4 percent by weight of the associative polyether thickener is used in the hydraulic fluids and metalworking fluids of the invention together with about 1 to about 15 percent by weight of the ethoxylated polyether surfactant, preferably about 2 to about 10 percent by weight and most preferably about 3 to about 5 percent by weight all based upon the weight of the hydraulic fluid.

Other conventional corrosion inhibitors and anti-wear additives can be utilized in conventional amounts in the hydraulic fluid of the invention. For instance, the ester of an ethoxylated aliphatic acid or alcohol can be utilized as an anti-wear or lubricant component of the hydraulic fluids of the invention. These are water-soluble esters of ethoxylated aliphatic monohydric or polyhydric alcohols having 8 to about 36 carbon atoms with aliphatic acids and aliphatic dimer acids. Such ethoxylated esters have a hydrophilic-lipophilic balance in the range of 10 to 20. The most desirable adducts are in the range of 13 to 18.

Useful ethoxylated aliphatic acids as antiwear additives have about 5 to about 20 moles of ethylene oxide added per mole of acid. Examples are ethoxylated oleic acid, ethoxylated stearic acid and ethoxylated palmitic acid. Useful ethoxylated dimer acids are oleic dimer acid and stearic dimer acid. Aliphatic acids can be either branched or straight-chain and can contain from about 8 to about 36 carbon atoms. Useful aliphatic acids include azelaic acid, sebacic acid, dodecanedioic acid, caprylic acid, capric acid, lauric acid, oleic acid, stearic acid, palmitic acid and the like. Especially useful for the purpose of obtaining the water-soluble esters of this invention are the aliphatic, preferably the saturated and straight-chain mono- and dicarboxylic acids containing from about 8 to 18 carbon atoms.

The dimer acids employed in the formation of the water-soluble esters employed in the aqueous lubricants of the present invention are obtained by the polymerization of unsaturated fatty acids having from 16 to 26 carbon atoms, or their ester derivatives. The polymerization of fatty acids to form the dimer fatty acids has been described extensively in the literature and thus need not be amplified here. The preferred dimer acids employed in the formation of the polyester are those which have 36 carbon atoms such as the dimer of linoleic acid and eleostearic acid. Other dimer acids having from 32 to 54 carbon atoms can be similarly employed. The dimer acids need not be employed in the pure form and can be employed as mixtures in which the major constituent, i.e., greater than 50 percent by weight, is the dimer acid and the remainder in unpolymerized acid or more highly polymerized acid such as trimer and tetramer acid.

The esters of the ethoxylated aliphatic alcohols which can be utilized in the hydraulic fluids and metalworking lubricant compositions of the invention as anti-wear additives are reaction products of ethoxylated monohydric or polyhydric alcohols.

Representative monohydric alcohols useful in the preparation of the esters of ethoxylated aliphatic alcohols are n-octyl, n-decyl, n-dodecyl (lauryl), n-tetradecyl (myristyl), n-hexadecyl (cetyl) and n-octadecyl alcohol. Useful representative polyhydric alcohols are ethylene glycol, diethylene glycol, polyethylene glycol, sucrose, butanediol, butenediol, butynediol, and hexanediol. Glycerol, sorbitol, pentaerythritol,trimethylolethane, and trimethylolpropane are particularly useful polyhydric alcohols which can be ethoxylated and subsequently esterified to produce the esters of ethoxylated aliphatic alcohols which can be used as anti-wear and corrosion-inhibiting components of the hydraulic fluids and metalworking compositions of the invention.

Representative monohydric aliphatic alcohols useful in the preparation of esters of ethoxylated aliphatic alcohols are generally those having straight chains and carbon contents of $C_8$–$C_{18}$. The alcohols are ethoxylated so as to add about 5 moles to about 20 moles of ethylene oxide by conventional ethoxylation procedures known to those skilled in the art. Such procedures are carried out under pressure usually in the presence of alkaline catalysts. The preferred monohydric aliphatic alcohols useful in producing the esters of the ethoxylated aliphatic alcohols of the invention are the linear primary alcohols having a chain length of $C_{12}$–$C_{15}$ and sold under the trademark "Neodol 25-3" or "Neodol 25-7" by the Shell Chemical Company.

Representative water-soluble polyoxyethylated esters having about 5 to about 20 moles of ethylene oxide residue per mole are the polyoxyethylene derivatives of the following esters; sorbitan monooleate, sorbitan trioleate, sorbitan monostearate, sorbitan tristearate, sorbitan monopalmitate, sorbitan monoisostearate, and sorbitan monolaurate.

In addition to the required associative polyether thickener and ethoxylated polyether surfactant, the metal-working and hydraulic fluid compositions of the invention can contain optionally alkyldialkanolamides of the formulas:

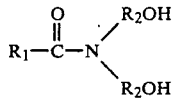

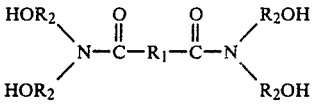

wherein $R_1$ is alkyl of about 4 to about 54, preferably about 4 to about 30, carbon atoms and $R_2$ is alkyl of about 2 to about 6 carbon atoms.

The alkyldialkanolamides are known compositions in the prior art. In general, these compositions are prepared by esterifying a dialkanolamine with an alkyl dicarboxylic acid and removing water of esterification. Useful alkyl dicarboxylic acids include branched or straight chain saturated or unsaturated aliphatic monocarboxylic or dicarboxylic acids as described below. Preferably, the saturated straight chain acids are used and, most preferably, the amides are diethanolamides. Examples of useful alkyldialkanolamides are the alkyl diethanolamides and alkyl dipropanol amides where the alkyl group is derived from a $C_8$–$C_{54}$ dicarboxylic acid.

The advantageous properties contributed to the hydraulic fluid by the alkyldialkanolamide component of the hydraulic fluid or metalworking fluid of the invention are resistance to precipitation in the presence of hard water, that is, in the presence of large amounts of calcium and magnesium ions in the water utilized to prepare the hydraulic fluid or metalworking fluid of the invention. In addition, the alkyldialkanolamides contribute to the antiwear and extreme pressure performance of the lubricant composition as well as to the metal corrosion resistance which is desirable in such fluids. The alkyldialkanolamides in aqueous solution are completely stable under neutral and alkaline conditions and show little tendency to hydrolyze or decompose on storage.

Stable concentrates of the hydraulic fluids and metalworking fluids of the invention can be prepared so that the hydraulic fluids and metalworking fluids or the invention can be prepared at the point of use rather than manufactured and shipped to the point of use thus saving considerable expense in shipping costs. The concentrates can be made up completely free of water or can contain up to 20 percent by weight of water in order to increase the fluidity thereof and provide ease of blending at the point of use.

When used in the hydraulic fluids of the invention, the weight proportion of phosphate ester or ethoxylated water-soluble aliphatic ester to alkyldialkanolamide can be about 0.1:1 to about 2:1, preferably about 0.5:1 to about 1.5:1 based upon the total weight of the phosphate ester and the alkyldialkanolamide. Most preferably, equal amounts of the ester of an ethoxylated aliphatic alcohol and alkyldialkanolamide are used. Generally, the hydraulic fluids and metalworking fluids of the invention are made up to contain 80 to 95 percent by weight water with the total proportion of conventional hydraulic fluid components, i.e., phosphate ester, polyester of an oxyalkylene compound, and alkyldialkanolamide being less than 2 percent by weight and the balance being made up by polymeric thickeners, corrosion inhibitors such as tolyltriazole and an imidazoline or an amine type vapor phase corrosion inhibitor.

The addition of conventional hydraulic fluid additives to the hydraulic fluids and metalworking fluids of the invention can provide the expected improvements usually contributed by such additives as metal corrosion inhibitors, water-based polymeric thickeners, mineral oils, and pH adjusting compounds. Surprisingly, chelating agents such as the sodium salt of ethylene diamine tetraacidic acid are not required when the hydraulic fluids contain an alkyldialkanolamide.

Other additives known in the prior art which contribute to metal corrosion inhibition can also be added to the compositions of the invention. These include known corrosion inhibitors of the prior art namely, amines, nitrites, and alkoxylated fatty acids. Useful amines are the aliphatic, cycloaliphatic and aromatic amines, as illustrated by those listed below. Useful nitrites are the alkali metal or alkaline earth metal nitrites such as sodium nitrite, potassium nitrite, barium nitrite and strontium nitrite. Useful alkoxylated fatty acids are alkoxylated oleic acid, alkoxylated stearic acid, and alkoxylated palmitic acid; useful alkoxylated dimer acids are oleic dimer acid and stearic dimer acid.

Useful amine corrosion inhibitors include the aliphatic, heterocyclic, and aromatic amines including the alkanolamines. Representative examples are as follows: butylamine, propylamine, n-octylamine, hexylamine, morpholine, N-ethyl morpholine, N-methyl morpholine, aniline, triphenylamine, aminotoluene, ethylene diamine, dimethylaminopropylamine, N,N,-dimethyl ethanolamine, triethanolamine, diethanolamine, monoethanolamine, 2-methyl pyridine, 4-methyl pyridine, piperazine, dimethyl morpholine and methoxypropylamine. A preferred vapor-phase corrosion inhibiting compound is morpholine. The corrosion inhibitors are used in the proportion of about 0.05 to about 1.5 percent by weight, preferably about 0.5 to about 1 percent by weight on the basis of the total weight of the hydraulic fluid or metalworking composition of the invention.

The hydraulic fluids of the invention can be used in various applications requiring hydraulic pressures in the range of 200 to 2000 pounds per square inch since they have all the essential properties required such as lubricity, viscosity stability and corrosion protection. The hydraulic fluids of the invention are suitable for use in various types of hydraulic systems and are especially useful in systems in which vane-type pumps or the axial-piston pumps are used. Such pumps are used in hydraulic systems where pressure is required for molding, clamping, pressing metals, actuating devices such as doors, elevators, and other machinery or for closing dies in die-casting machines and in injection molding equipment and other applications.

As a means of determining the viscosity stability of the hydraulic fluids of the invention, the viscosity was determined at a temperature of 100° F. and compared with the viscosity at 130° F. Viscosity measurements were made utilizing a Cannon-Fenske capillary viscometer.

The following examples illustrate the various aspects of the invention but are not intended to limit its scope. Where not otherwise specified throughout this specification and claims, temperatures are given in degrees centigrade and parts, percentages, and proportions are by weight.

EXAMPLE 1

A liquid heteric copolymer containing 80 percent by weight of the residue of ethylene oxide, 15 percent by weight of the residue of 1,2-propylene oxide and 5 percent by weight of the residue of an alpha-olefin oxide having an aliphatic carbon chain length of 15 to 18 carbon atoms was prepared according to the following procedure. A polyether derived from ethylene oxide and 1,2-propylene oxide in the weight ratio of 75 percent ethylene oxide and 25 percent 1,2-propylene oxide was prepared by reaction with trimethylolpropane in two stages in a stainless steel autoclave. A first intermediate product was prepared by reacting a mixture of trimethylolpropane, potassium hydroxide, 1,2-propylene oxide, and ethylene oxide for a period of 18 hours at 120° C. The final product was prepared in a second stage by reacting the previously prepared intermediate with a mixture of 1,2-propylene oxide and ethylene oxide under a nitrogent atmosphere at 115° C. for 22 hours. The product had a molecular weight of about 23,000.

A glass flask was charged with 1410 grams of the final polyether product prepared above and heated to 105° C. while maintaining a nitrogen atmosphere. There was then added with stirring 10.2 grams of sodium and the mixture reacted for a period of 24 hours. The intermediate product obtained thereby was cooled to room temperature prior to further use. Thereafter a 250 ml centrifuge bottle was charged with 100 grams of this intermediate product together with 3.3 grams of 1,2-propylene oxide and 19 grams of ethylene oxide. The contents of the bottle were mixed at room temperature and after the bottle was stopped with a rubber stopper, the bottle was placed in a steam bath for 24 hours. This product was cooled to room temperature before further use. To the centrifuge bottle containing this product, there was added 2.5 grams of an alpha-olefin oxide having an aliphatic carbon chain length of 15 to 18 carbon atoms together with 3.3 grams of 1,2-propylene oxide and 19 grams of ethylene oxide. The contents of the bottle were further mixed and the bottle was stoppered and placed in a steam bath for 21 hours after which a viscous product was obtained.

EXAMPLE 2

(Comparative Example)

A polyether derived from ethylene oxide and 1,2-propylene oxide in the weight ratio of 75 percent ethylene oxide and 25 percent 1,2-propylene oxide was prepared by reaction with trimethylolpropane in a manner similar to the process described in Example 1 for the preparation of the intermediate product having a molecular weight of about 23,000. The product obtained by this procedure had a molecular weight of about 23,000.

EXAMPLE 3

A heteric copolymer of ethylene oxide and 1,2-propylene oxide having a theoretical molecular weight of 8717 is prepared which is subsequently further reacted with an alpha-olefin oxide mixture of alpha-olefin oxides having 15 to 18 carbon atoms. There was charged 972 grams of stearyl alcohol, 89.6 grams of a 45 percent by weight aqueous solution of potassium hydroxide, and the mixture was heated with stirring at 115° C. at a pressure of less than 10 mm of mercury for 30 minutes. The vacuum was relieved with dry nitrogen to a pressure of 5 pounds per square inch gauge, and a mixture of 407 grams of 1,2-propylene oxide, and 1220 grams of ethylene oxide were added over a period of 4¾ hours at a temperature of 115° C. After addition was complete, the mixture was stirred 70 minutes at 115° C. and cooled to 80° C. The product was labeled "Intermediate No. 1" and thereafter discharged to a gallon glass bottle for use in the next step of the process.

Using "Intermediate No. 1," 476 grams were charged to a one-gallon stainless steel autoclave which had been previously flushed with nitrogen and heated for 15 minutes at a temperature of 115° C. and a pressure of 10 mm of mercury. After relieving the vacuum to a pressure of 5 pounds per square inch gauge with nitrogen, a mixture of 1303 grams of 1,2-propylene oxide and 3909 grams of ethylene oxide were added over a period of 14 hours at a temperature of 115° C. After addition of these ingredients was complete, the mixture was stirred for a period of two hours at a temperature of 115° C. and then the mixture was cooled to 80° C. A second intermediate product was discharged to a one-gallon bottle in a yield of 5549 grams.

Utilizing 2600 grams of the second intermediate product, a 5 liter glass vessel was charged therewith and thereafter the vessel and its contents were heated at a temperature of 120° C. under a nitrogen atmosphere at a pressure of 20 mm of mercury for a period of 30 minutes. Thereafter, 76 grams of a mixture of alpha-olefin oxides having 15 to 18 carbon atoms was added all at once. After heating this mixture for a period of 8 hours at a temperature of 120° C. under a nitrogen atmosphere at atmospheric pressure, the product was cooled to 80° C. and discharged to a glass container. The product was characterized as a viscous brown liquid at room temperature.

EXAMPLES 4–14

Aqueous solutions were prepared utilizing the polyether thickener prepared in Example 1 which was treated with various surfactants in the amounts detailed in the following table. Viscosity of the aqueous solutions was measured at both 100° F. and 130° F., and the ratio of the viscosity at 100° F. over the viscosity at 130° F. was calculated. Generally, the lower the ratio, the less sensitive the aqueous solution is to viscosity reduction at 130° F. as compared to the viscosity at 100° F.

EXAMPLES 15–22

Examples 4–10 are repeated using the polyether thickener of Example 3. A similar reduction in viscosity dependence on temperature is obtained.

TABLE

| Example | Surfactant | Surfactant Concentration (% by weight) | Polyether of Example 1 (% by weight) | Viscosity (cst.) @ 100° F. | Viscosity (cst.) @ 130° F. | Viscosity Ratio @ 100° F. / @ 130° F. |
|---|---|---|---|---|---|---|
| 4 | Surfactant A[1] | 4 | 3 | 312 | 90 | 3.5 |
| 5 | Surfactant A | 5 | 3 | 266 | 85 | 3.1 |
| 6 | Surfactant B[2] | 1 | 3 | 88 | 18 | 4.9 |
| 7 | Surfactant C | 1 | 3 | 70 | 18 | 3.8 |
| 8 | Surfactant C | 5 | 3 | 601 | 187 | 3.2 |
| 9 | Triton X-100[3] | 5 | 3 | 133 | 30 | 4.4 |
| 10 | Ethomeen T/25[4] | 5 | 3 | 195 | 66 | 2.9 |
| 11 (control) | — | — | 5 | 309 | 47 | 6.5 |
| 12 (control) | — | — | 4 | 84 | 16 | 5.3 |
| 13 (control) | Mineral oil | — | — | 13.7 | 8.2 | 1.7 |
| 14 (control) | Surfactant D[5] | 23 | — | 61 | 39 | 1.6 |

Notes
[1]Surfactant A has a molecular weight of about 1000 and is derived by the reaction of a mixture of ethylene oxide and 1,2-propylene oxide with a saturated linear alcohol having about 12 to about 18 carbon atoms.
[2]Surfactants B and C have molecular weights respectively of about 3000 and 4500 and are derived from the reaction of a mixture of 1,2-butylene oxide and ethylene oxide with ethylene glycol.
[3]Triton X-100 is ethoxylated octyl phenol (about 10 moles of ethylene oxide).
[4]Ethomeen T25 is a tallow amine ethoxylate (about 15 moles of ethylene oxide).
[5]Surfactant D is an alkoxylated trimethylolpropane having a molecular weight of about 23,000 derived from ethylene oxide and 1,2-propylene oxide, (see Comparative Example 2).

While this invention has been described with reference to certain specific embodiments, it will be recognized by those skilled in the art that many variations are possible without departing from the scope and spirit of the invention and it will be understood that it is intended to cover all changes and modifications of the invention disclosed herein for the purposes of illustration which do not constitute departures from the spirit and scope of the invention.

The embodiments of the invention in which an exclusive property or privilege is claimed are defined as follows:

1. A hydraulic fluid or metalworking fluid comprising a major proportion of water, minor effective thickening amounts of at least one associative, polyether, aqueous thickener, and minor, effective, temperature-stabilizing amounts of at least one ethoxylated polyether surfactant.

2. The hydraulic fluid or metalworking fluid of claim 1 wherein said fluid contains:

(A) at least one associative polyether thickener having a molecular weight of about 1000 to about 75,000 prepared by reacting ethylene oxide or ethylene oxide and at least one lower alkylene oxide with at least one active hydrogen-containing compound containing at least one active hydrogen and at least one long chain aliphatic alpha-olefin oxide or long chain aliphatic glycidyl ether each having a carbon chain length of about 12 to about 18 carbon atoms and wherein said alpha-olefin oxide or aliphatic glycidyl ether is present in the amount of 1 to about 20 percent by weight based upon the total weight of said thickener, and (B) an ethoxylated polyether surfactant selected from the group consisting of at least one of (1) a polyether copolymer initiated with an aliphatic alcohol or amine having about 12 to about 18 carbon atoms prepared by reacting, with said amine or alcohol, ethylene oxide and a lower alkylene oxide wherein at least 70 percent by weight of said polyether is the residue of ethylene oxide;

(2) a polyether initiated with an alkyl phenol having about 1 to about 20 carbon atoms in the alkyl group prepared by reacting about 5 to about 20 moles of ethylene oxide or ethylene oxide with at least one lower alkylene oxide with the proviso that the residue of ethylene oxide is present in the proportion of at least 60 percent by weight of said polyether;

(3) a polyoxybutylene-polyoxyethylene copolymer wherein the polyoxybutylene portion of the polymer has a molecular weight of about 500 to about 2000 and the polyoxyethylene portion of said copolymer provides about 60 to about 90 percent by weight of said copolymer; and (4) a polyether homopolymer initiated with an aliphatic alcohol or amine having about 12 to about 18 carbon atoms prepared by reacting said alcohol or amine with about 5 moles to about 30 moles of ethylene oxide per mole of alcohol or amine.

3. The composition of claim 2 wherein said hydraulic fluid contains a phosphate ester salt selected from the group consisting of

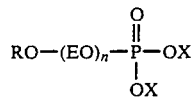

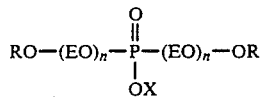

and mixtures thereof wherein EO is the residue of ethylene oxide; R is an alkylaryl group wherein the alkyl group thereof has about 4 to about 20 carbon atoms; X is individually selected from the group consisting of an alkali metal, an alkaline earth metal, the residue of ammonia, the residue of an amine, and mixtures thereof; n is a number from 1 to 50.

4. The composition of claim 3 wherein said phosphate ester salt is the condensation product of an alkyl phenol having 4 to 20 carbon atoms in the alkyl group with about 5 to about 20 moles of ethylene oxide and wherein said alkyl phenol is selected from the group consisting of octyl phenol, nonylphenol, dinonylphenol, dodecylphenol and mixtures thereof.

5. The composition of claim 2 wherein said alkyl phenol (B)(2) is selected from the group consisting of octyl phenol, nonylphenol, dinonylphenol, dodecylphenol and mixtures thereof.

6. The composition of claim 5 wherein said alkoxylated alkyl phenol is octyl phenol ethoxylated with 10 moles of ethylene oxide.

7. The composition of claim 2 wherein said polyether (B)(1) is at least one of an alkoxylated linear aliphatic alcohol or amine which is the reaction product of an alcohol or amine mixture having 12 to 15 carbon atoms in the chain.

8. The composition of claim 7 wherein said polyether is a homopolymer prepared by reacting said alcohol or amine with ethylene oxide or a block or heteric copolymer prepared by reacting ethylene oxide and at least one of propylene oxide and butylene oxide.

9. The composition of claim 8 wherein said polyether is the reaction product of said alcohol or amine with about 5 to about 20 moles of ethylene oxide or has a total molecular weight of about 500 to about 2000.

10. The polyoxyalkylene-polyoxybutylene copolymer of claim 2 (B)(2) wherein said copolymer is a block copolymer.

11. A process of metalworking comprising working metal in the presence of the metalworking composition of claim 2.

12. A process for the transmitting of force hydraulically comprising transmitting force utilizing the hydraulic fluid of claim 2.

13. A process for stabilizing the viscosity of a water-based hydraulic fluid containing at least one associative, polyether, aqueous thickener comprising adding thereto minor, effective, temperature-stabilizing amounts of at least one ethoxylated polyether surfactant.

14. The process of claim 13 wherein said associative polyether thickener has a molecular weight of about 1000 to about 75,000, wherein said polyether thickener is prepared by reacting ethylene oxide or ethylene oxide and at least one lower alkylene oxide with at least one active hydrogen-containing compound containing at least one active hydrogen and at least one aliphatic alpha-olefin oxide or aliphatic glycidyl ether each having a carbon chain length of about 12 to about 18 carbon atoms, wherein said alpha-olefin oxide or aliphatic glycidyl ether is present in the amount of 1 to about 20 percent by weight based upon the total weight of said thickener, and said ethoxylated polyether is selected from the group consisting of at least one of (1) a polyether initiated with an aliphatic alcohol or amine having about 12 to about 18 carbon atoms prepared by reacting, with said amine or alcohol, ethylene oxide and a lower alkylene oxide wherein at least 70 percent by weight of said polyether is the residue of ethylene oxide;

(2) a polyether initiated with an alkyl phenol having about 1 to about 20 carbon atoms in the alkyl group prepared by reacting about 5 to about 20 moles of ethylene oxide or ethylene oxide with at least one of propylene oxide and butylene oxide with the proviso that the residue of ethylene oxide is present in the proportion of at least 60 percent by weight of said polyether; and p1 (3) a polyoxybutylene-polyoxyethylene copolymer wherein the polyoxybutylene portion of the polymer has a molecular weight of about 500 to about 2000 and the polyoxyethylene portion of said copolymer provides about 60 to about 90 percent by weight of said copolymer.

* * * * *

Disclaimer 4,491,526.—*Charles F. Deck*, Trenton, Mich. THICKENED WATER-BASED HYDRAULIC FLUID WITH REDUCED DEPENDENCE OF VISCOSITY ON TEMPERATURE. Patent dated Jan. 1, 1985. Disclaimer filed May 18, 1988, by the assignee, *BASF Corp.*

Hereby enters this disclaimer to claims 1-14 of said patent.

[*Official Gazette March 14, 1989.*]